United States Patent [19]

Kitabayashi

[11] Patent Number: 4,457,697

[45] Date of Patent: Jul. 3, 1984

[54] THROWAWAY TYPE GAS LIGHTER

[76] Inventor: Seiichi Kitabayashi, No. 919-12, Oaza Koshikiya, Ageo-shi, Saitama, Japan

[21] Appl. No.: 339,321

[22] Filed: Jan. 15, 1982

Related U.S. Application Data

[62] Division of Ser. No. 55,954, Jul. 9, 1979, Pat. No. 4,325,692.

[30] Foreign Application Priority Data

| | | | |
|---|---|---|---|
| Jul. 19, 1978 | [JP] | Japan | 53-98295 |
| Nov. 10, 1978 | [JP] | Japan | 53-154079 |
| Feb. 8, 1979 | [JP] | Japan | 54-14430 |
| Mar. 29, 1979 | [JP] | Japan | 54-39956 |

[51] Int. Cl.[3] ..... F23Q 1/04

[52] U.S. Cl. ..... 431/254; 431/276; 431/277

[58] Field of Search ..... 431/130, 131, 150, 151, 431/143, 254, 273, 276, 277, 344

[56] References Cited

U.S. PATENT DOCUMENTS

| | | | |
|---|---|---|---|
| 3,270,925 | 9/1966 | Obst | 222/402.21 |
| 3,484,178 | 12/1969 | Weissmann | 431/343 |
| 3,533,718 | 10/1970 | Shuto | 431/277 |
| 3,650,660 | 3/1972 | Huguet | 431/277 |
| 3,740,183 | 6/1973 | Piffath et al. | 431/252 |
| 3,784,352 | 1/1974 | Court | 431/277 |
| 3,854,862 | 12/1974 | Webster | 431/344 |

*Primary Examiner*—Carroll B. Dority, Jr.

*Attorney, Agent, or Firm*—Fulwider, Patton, Rieber, Lee & Utecht

[57] ABSTRACT

A throwaway type gas lighter is disclosed which comprises a windbreak, a fuel tank filled with a liquefied fuel gas, a spark generating mechanism including a rasp wheel and a spring-biased flint, fuel supplying means including a fuel injection pipe for supplying the fuel gas from the fuel tank, an outer valve member made of elastic resilient material and sealingly surrounding the fuel injection pipe for selectively preventing the fuel gas from flowing and allowing the same to flow therethrough when the outer valve member is suitably deformed, and fuel supply adjusting means for adjusting the fuel flow rate in the fuel injection pipe whereby when the outer valve member is actuated and the rasp wheel is rotated, the ignition is completed.

4 Claims, 16 Drawing Figures

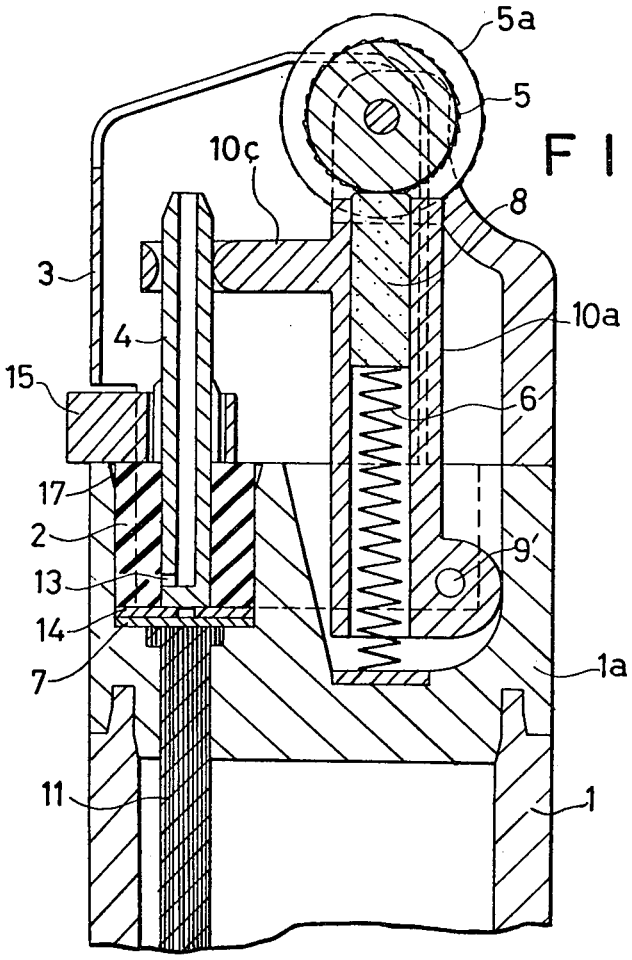
FIG. 6
FIG. 7
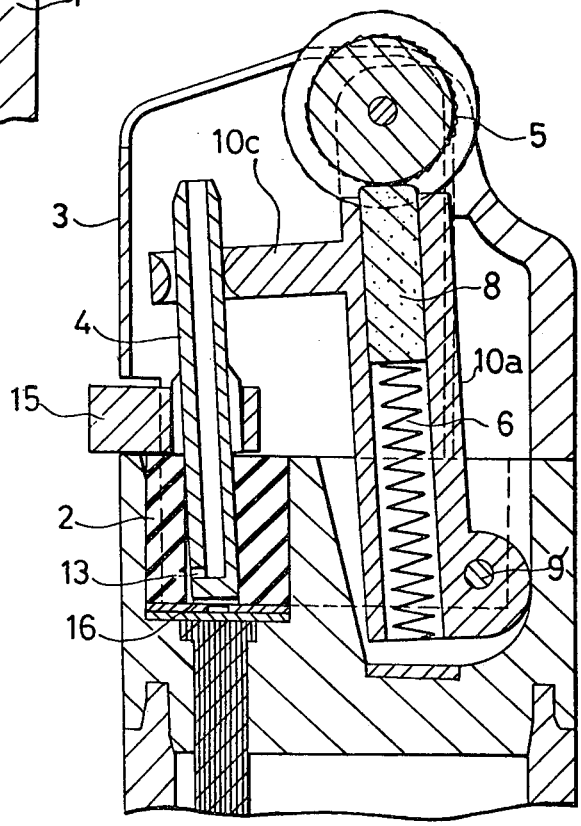

THROWAWAY TYPE GAS LIGHTER

This is a division, of application Ser. No. 06/055,954, filed July 9, 1979, now U.S. Pat. No. 4,325,692.

BACKGROUND OF THE INVENTION

This invention relates to a throwaway type gas lighter used only once and then thrown away, more particularly to a novel valve mechanism for such a type of a gas lighter.

In such a gas lighter, it is especially desired that the manufacturing cost is low and a construction is simple. Typically, a gas lighter having a seesaw type valve actuating mechanism has been provided. However, such a prior art throwaway type gas lighter requires various mechanical parts because the seesaw type valve actuating mechanism is very complicated for a throwaway type gas lighter. A design of a prior art gas lighter is unduly limited due to usage of the seesaw type valve mechanism which is rather large in size in particular in its longitudinal direction. Also, for this designing limitation, a shape of a fuel tank is limited to a rectangular receptable. Further, in the prior art lighter, the fuel is accidentally leaked through a valve mechanism in a user's pocket. This is very dangerous.

SUMMARY OF THE INVENTION

In view of the above-noted defects, an object of the present invention is to provide a throwaway type gas lighter which is very simple in construction.

Another object of the present invention is to provide a throwaway type gas lighter a configuration of which is freely designed due to a usage of a simple and compact valve mechanism.

Another object of the present invention is to provide a throwaway type gas lighter suitable for a mass-production at low cost.

Still another object of the present invention is to provide a throwaway type gas lighter having a novel fuel flow adjusting means and an accidental fuel supply preventing mechanism.

The foregoing and other objects are achieved by providing a throwaway type gas lighter having a windbreak, a fuel tank, a spark generating mechanism, fuel supplying means including a fuel injection pipe, a novel outer valve member made of rubber or the like and sealingly surrounding the fuel injection pipe, and novel fuel supply adjusting means.

BRIEF DESCRIPTION OF THE DRAWINGS

In the accompanying drawings:

FIG. 6 is a cross sectional view showing a primary part of a second embodiment of the gas lighter according to the present invention;

FIG. 7 is a cross sectional view showing another state of the gas lighter shown in FIG. 6;

DETAILED DESCRIPTION OF THE PREFERRED EMBODIMENTS

Figure 1:
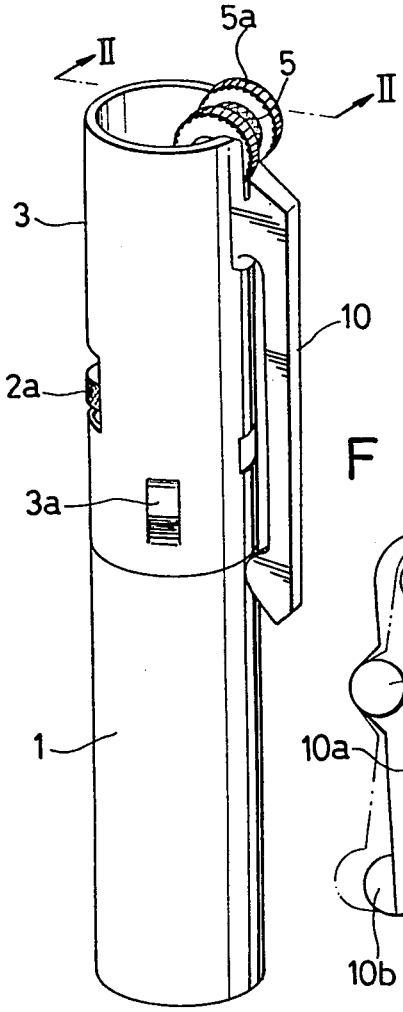
FIG. 1 is a perspective view showing a first embodiment of a throwaway type gas lighter according to the present invention.
Figure 2:
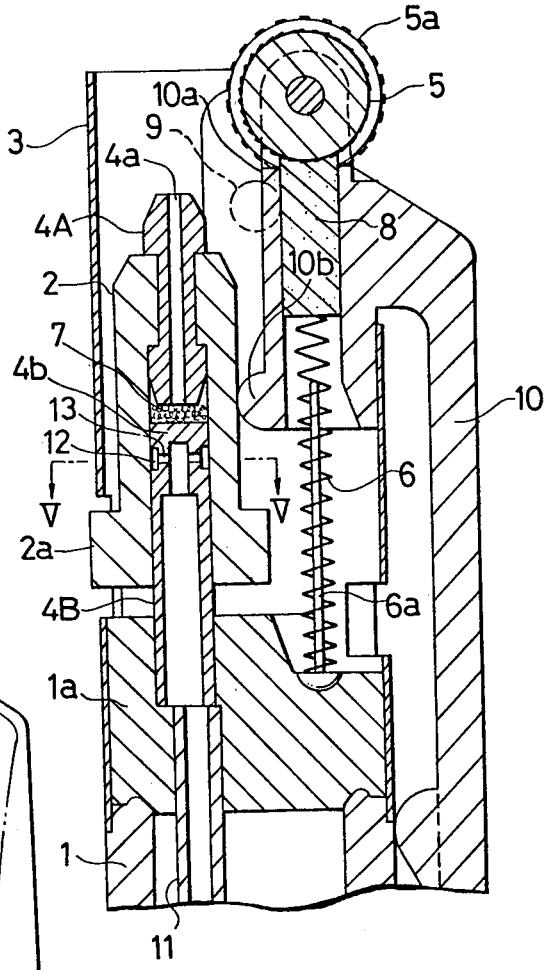
FIG. 2 is an enlarged cross sectional view showing a primary part of the gas lighter shown in FIG. 1.
Figure 3:
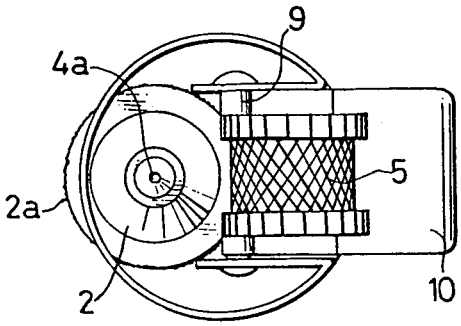
FIG. 3 is a top view of the gas lighter shown in FIG. 1.

A first embodiment according to the present invention will be hereinafter described in reference to FIGS. 1 and 2. FIG. 1 is a perspective view of a simple lighter using a liquefied gas such as butane, consisting of a fuel tank 1, a windbreak 3, a rasp wheel 5, a finger friction wheel **5*a* and an operational rod or clip 10. In FIG. 2, the windbreak 3 is secured to the fuel tank 1 by a pair of cut portions 3*a* formed on a cylindrical surface of the windbreak 3. Fuel injection pipes 4A and 4B communicable to the fuel tank 1 through a fuel supply pipe 11 are provided in the windbreak 3. The lower pipe 4B is fixedly implanted in a disc member 1*a*. The upper end portion 4*b* of such lower pipe 4*b* is closed. A vertical sleeve portion 10*a* of a clip 10 may be carried rotatably from the windbreak 3 by means of a transverse clip support rod 9 and is formed on its lower free extremity with a laterally inwardly projecting cam. A vertical flint 8 is inserted into the sleeve portion 10*a* of the clip 10 made of plastics or the like and serves to generate a spark cooperating with the rasp wheel 5 which is rotated together with the finger friction wheel 5*a*. The finger friction wheel may be dispensed with so that the rasp wheel is rotated directly by the user's finger. The flint 8 is always urged upward by a coil compression spring 6 which is supported by an arial spring support rod 6*a*. As shown in FIG. 3, the transverse clip support rod 9 is secured on its opposite ends to a pair of inwardly bent portions of the windbreak. An outer valve member 2 which is made of elastic resilient material such as rubber sealingly surrounds the fuel injection pipes 4A and 4B. A clip carriage is formed with an abutting portion 10*b* formed at a lower end of the sleeve portion 10*a* to pressingly abut to a suitable portion of the outer valve member 2 when an intermediate portion of the clip 10** is pressed to the lighter body as shown in FIG. 4.

A porous material 17 is inserted between the upper and lower fuel injection pipes 4A and 4B in the outer valve member 2. A fuel gas always rises to an annular groove 12 through a lateral hole 13 but the fuel gas is normally prevented from rising by an upper portion **4*b* of the lower pipe 4B. A fuel flow rate is adjustable according to the degree of compression of the porous material 7. The degree of compression of the porous material is variable according to a distance between the upper and lower fuel injection pipes 4A and 4B. The distance between the pipes 4A and 4B** is varied by moving a flanged portion 2*a* of the outer valve member up and down.

Figure 4:
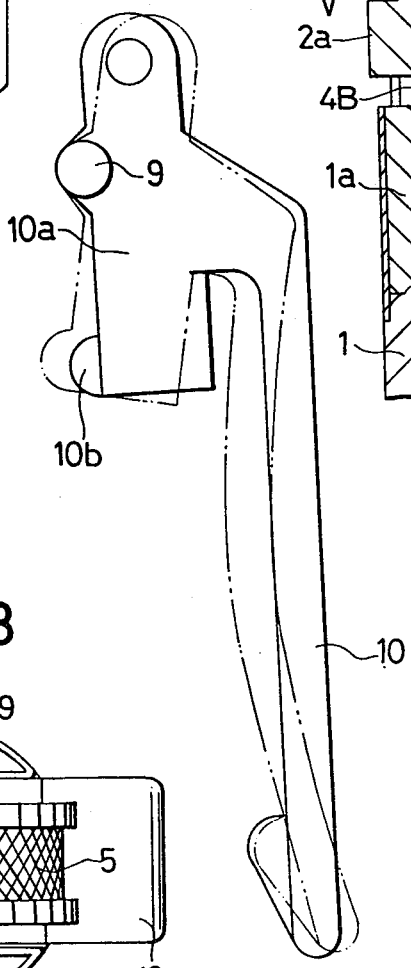
FIG. 4 is an explanatory view of a clip assembly of the gas lighter shown in FIG. 1.
Figure 5:
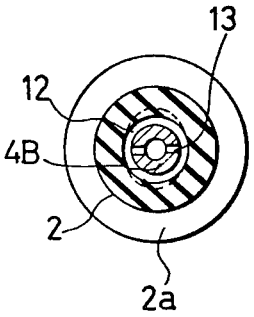
FIG. 5 is a cross sectional view taken along a line V—V in FIG. 2.

In operation, when the intermediate portion of the clip 10 is, as shown in FIG. 4, pressed toward the lighter body, the projected portion 10*b* pressingly abuts to the outer valve member 2 to thereby deform the outer valve member 2 as indicated by dotted line in FIG. 5 so that a fuel can flow through the upper portion 4*b* of the lower pipe 4B and the porous material 7 to an injection tip of the upper pipe 4A. Then, the rasp wheel is rotated by the user's thumb to thereby generate a spark of the flint 8. The ignition is completed. When the generated flame is unnecessary, the pressing force applied to the intermediate portion 10 is simply released to thereby cut the fuel feeding.

According to this embodiment, the operational clip 10 is made of flexible material and the sleeve portion 10*a* is slanted backwardly with the rasp wheel moved backwardly. Therefore, the distance between the injection tip 4*a* and the raps wheel can be predeterminedly shortened in comparison with a conventional seesaw type operational member corresponding to the clip 10 of the first embodiment. As a result, according to the present invention, a slim cylindrical lighter like a pen can be readily obtained. In such a simplified type lighter, a fuel tank is filled with a fuel from the upper portion. In this case, according to the present invention, before the upper pipe 4A and the porous material 7 are inserted into the outer valve member, the outer valve member serves as a check valve during fuel supplying to the fuel tank. This makes assembly procedures and works easy.

FIGS. 6 and 7 show a second embodiment of a gas lighter according to the present invention. In the following embodiments, like members or parts will be used with the same reference numerals as used in FIGS. 1 to 5. Element 1 is a fuel tank which is made of a transparent material in order to readily observe a filled fuel therein. An outer valve member 2 is made of a softened flexible material and inserted into a hole of a disc member 1*a*. A fuel injection pipe 4 is implanted in the outer valve member 2 and has a small lateral hole 13 in a lower end portion thereof. In no-use state shown in FIG. 6, the lateral hole 13 is closed by an inner wall of the outer valve member 2. A sleeve 10*a* is rotatably supported by a shaft 9' secured to the disc member 1*a*. A rasp wheel 5 and a frictional wheel 5*a* are provided on the sleeve 10*a* and a flint 8 urged by a spring 6 is surrounded by the sleeve 10*a*. An arm plate 10*c* extends from an upper portion of the sleeve 10*a*. An adjusting knob 15 is loosely engaged with a longitudinal teeth formed on the fuel injection pipe 4. By the rotation of the knob 15, the fuel flow rate is adjusted. Element 7 is a porous material which serves to rectify the flow of the fuel gas and element 14 is a washer having a through-hole therein. Element 11 is a fuel supply pipe made of a flux of polyethylene fibers. Element 3 is a windbreak.

When the rasp wheel is pressed forwardly and rotated, the fuel injection pipe 4 is slanted by the pressing action of the arm plate 10*c*, and the outer valve member is deformed so as to produce a gap 16 between the lateral hole 13 and the outer valve member 2 and a continuous fuel passage to thereby complete the ignition.

An adjustment of the fuel flow rate is readily achieved by rotating the adjust knob 15 to direct the lateral hole 13 in the side direction. If the lateral hole 13 is directed backward, the fuel can be prevented to flow through the injection pipe 4. Therefore, if the injection pipe is turned to the backward, accidental fuel leakage can be prevented. This is suitable for carrying the lighter.

Also, according to this embodiment, a compact lighter is simple in construction. A fuel supply to the fuel tank of the lighter is readily achieved through a fuel injection pipe in the factory.

Figure 8:
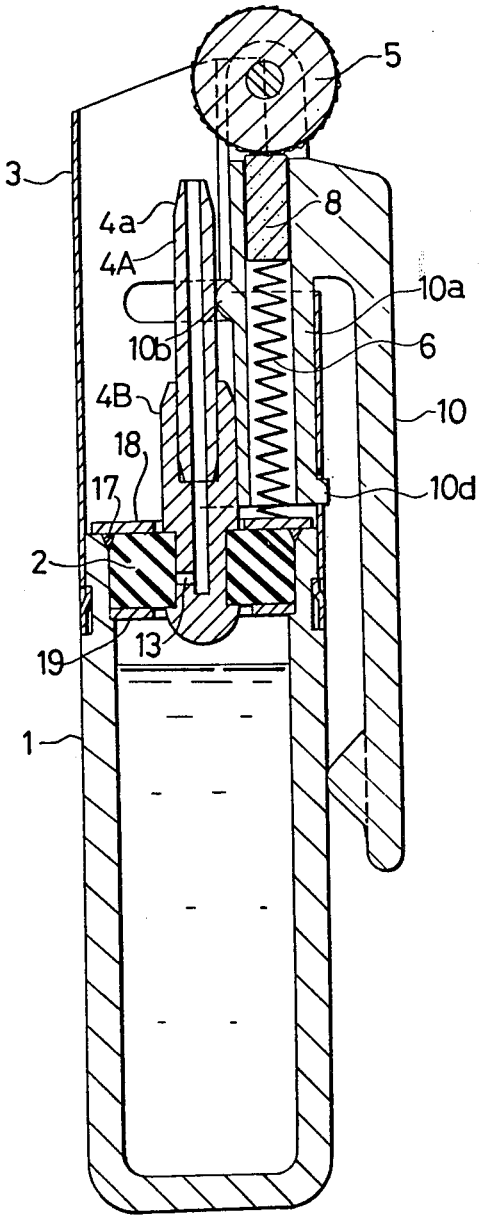
FIG. 8 is a cross sectional view showing a third embodiment of the gas lighter according to the present invention.
Figure 9:
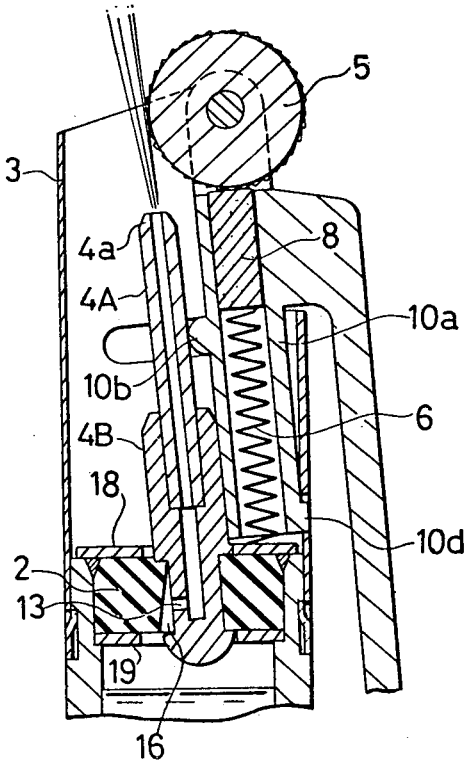
FIGS. 9 and 10 are cross sectional, in part, views showing other states of the gas lighter shown in FIG. 8.
Figure 10:
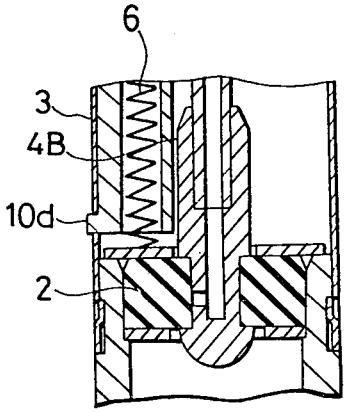

FIGS. 8 to 10 show a third embodiment of a gas lighter according to the present invention.

In this embodiment, an outer valve member 2 serves a multifunction member. That is, the outer valve member serves as a lid for a fuel tank 1, a fuel supply control valve and an adjusting member of a fuel flow rate. A cylindrical windbreak is rotatably secured to a fuel tank 1. A mutual relationship between a clip 10 and a fuel tank 1 is freely variable. An indication mark (not shown) is useful for indicating the positional relationship therebetween. A clip assembly consisting of a clip 10, a sleeve 10*a*, a rasp wheel, a spring 6 and a flint 8 is rotated together with windbreak 3. In contrast, a lower pipe 4B coupled to a fuel injection pipe 4A is implanted in the outer valve member 2 which is sandwiched by an outer protect disc 18 and a lower protect disc 19 each having a through-hole therein. The lower pipe 4B has a lateral hole 13 facing to the inner side wall of the outer valve member 2 and a flanged portion at the lower end thereof for sealing the fuel tank. The outer valve member is fixedly inserted into the fuel tank with an adhesive 17. A sleeve 10*a* has a projection 10*b*. The clip assembly is provided so that the vertically implanted and the fuel injection pipe 4 can be pressed in any direction. The sleeve 10*a* is supported by the windbreak 3 through a suitable support rod (not shown).

When the upper portion of the clip is pushed forwardly, the fuel injection pipe 4 is slanted and if the lateral hole is directed forwardly, a gap 16 is produced between the lateral hole and the outer valve member so that a fuel gas can be supplied therethrough to an injection tip 4*a*. In this state, the rasp wheel 5 is rotated to thereby generate a spark to complete the ignition. When the lateral hole is directed to the closed direction as shown in FIG. 10, the fuel is not supplied even if the upper portion of the clip is pushed inwardly.

In the preceding embodiments, at least one lateral hole is required in the fuel injection pipe. However, this is liable to incur a trouble because a metal tube is machined with high mechanical accuracy. In view of this, in the following embodiment, a formation of such a lateral small hole in the metallic pipe can be dispensed with. FIGS. 11 to 15 show a fourth embodiment of a gas lighter according to the present invention.

Element 1 is a fuel tank a configuration of which is cylindrical, in this embodiment. A top opening portion of the fuel tank is plugged by an outer valve member 2 with an adhesive 17. An upstanding fuel injection pipe 4 is sealingly inserted at its lower extremity into the upper bore formed in the outer valve member 2 and project upwardly vertically therefrom. The hole 23 is blind at its bottom end but is in communication with an axially offset hole 24 which is blind at its top end and opens downwardly from the lower side of the outer valve member 2.

A flint retaining barrel member 22 is secured to a windbreak 3' but slidable in the vertical direction. The windbreak 3' is in the form of a cylindrical shell open on one side and formed with internal confronting teeth 3*b*' (FIG. 14) engaged with a plurality of vertical grooves 22*a* (FIG. 13) formed in the flint retaining member 22

Figure 13:
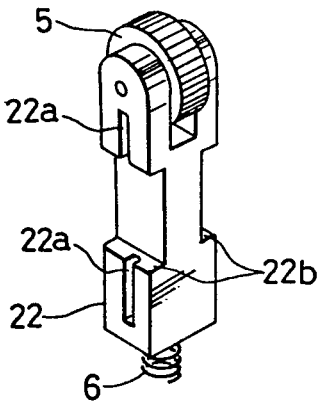
FIG. 13 is a perspective view showing a flint retaining member used in the gas lighter shown in FIG. 11.
Figure 14:
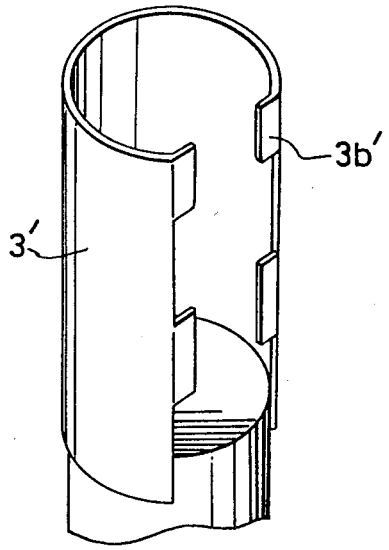
FIG. 14 is a perspective view showing a windbreak used in the gas lighter shown in FIG. 11.

(FIG. 13). The windbreak 3' is secured to the upper portion of the fuel tank 1. Received telescopically in the upper extremity of the bore of the barrel 22 is a cylindrical flint which is biased upwardly by means of a coil compression spring 6.

Figure 11:
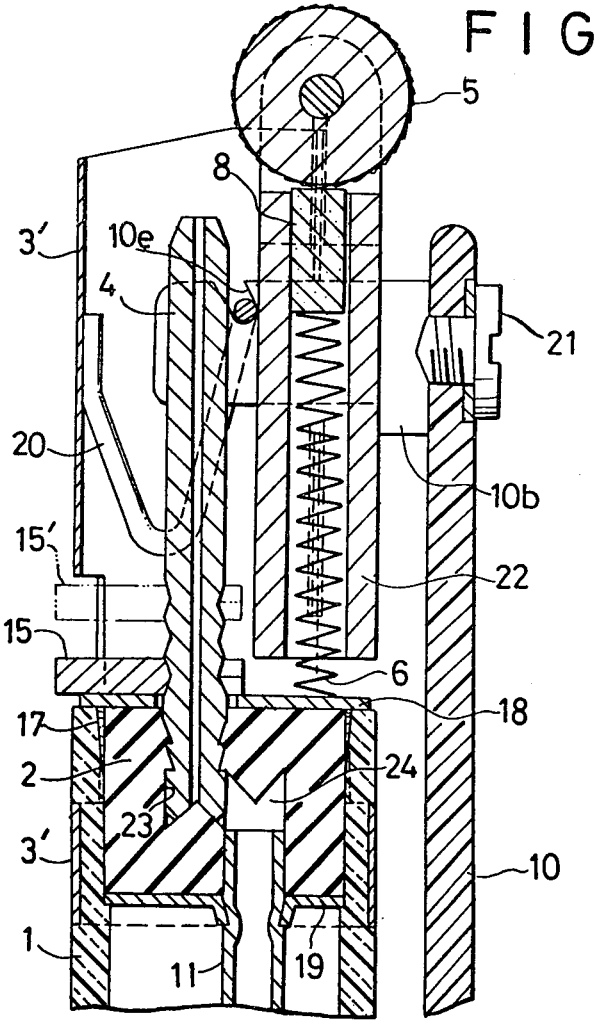
FIG. 11 is an enlarged cross sectional, in part, view showing a fourth embodiment of the gas lighter according to the present invention.
Figure 12:
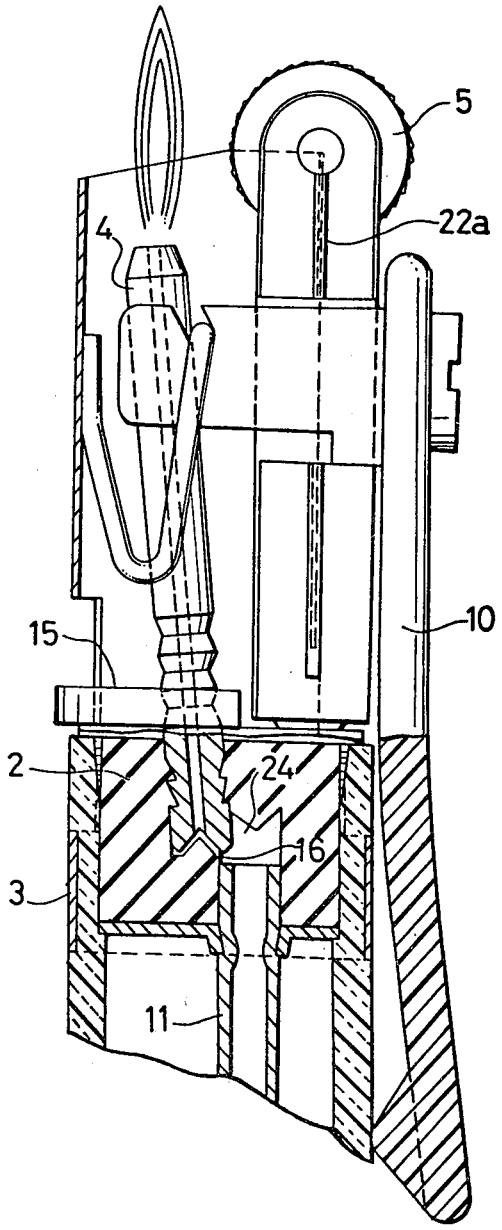
FIG. 12 is an enlarged cross sectional, in part, view showing another state of the gas lighter, in which a flame is produced, shown in FIG. 11.
Figure 15:
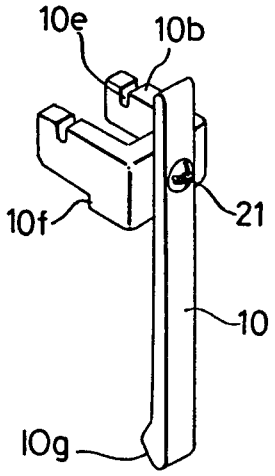
FIG. 15 is a perspective view showing a clip assembly used in the gas lighter shown in FIG. 11.

A vertical clip assembly consists of a carriage formed with a clip rod 10 and a pair of horizontal arms 10*b* secured to the clip rod 10 by a screw 21 as best shown in FIG. 15. The clip terminates at its lower extremity in an inwardly projecting cam 10*g* which engages the body 1 of the lighter. A U-shaped spring member 20 secured on one side to the windbreak with a suitable adhesive or by welding and is engaged on its opposite side with grooves 10*e* formed in the arms 10*b* to thereby urge the clip assembly transversely outward in the windbreak 3'. In FIG. 11, transverse movement inwardly of the clip assembly is limited by engagement of the steps 10*f* (FIG. 15) with shouldered portions 22*b* of the flint retaining member. However, when the rasp wheel 5 is pushed down, the abutment between the stepped portions 10*f* and the shouldered portions 22*b* is released to thereby allow the arm 10*b* to move forwardly by the pushing operation of the clip rod 10. As a result, the fuel injection pipe 4 is slanted by the pushing force of the rod against the spring force due to the spring member 20. When the fuel injection pipe 4 is slanted, a gap 16 is produced to thereby supply the injection pipe with a fuel gas. A gas lighter according to this embodiment is easy to use in a natural gripping state of the operator's hand. In this embodiment, the small lateral hole is not used in the injection pipe and hence, there is no possibility of clogging.

A pipe slant stopper 15 serves as an adjustment fulcrum. When the stopper 15 is lifted at 15' as shown in FIG. 11, the slant degree becomes small to thereby reduce a flow rate of the fuel.

Figure 16:
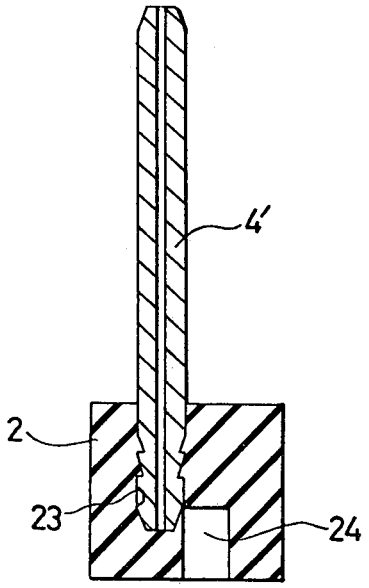
FIG. 16 is a modification of an outer valve member.

FIG. 16 shows a modification of holes 23 and 24 formed in the outer valve member 2. A lower end of a fuel injection pipe 4' is rounded. In no-use state, the fuel gas is prevented from flowing upward. Substantially the same effect can be obtained.

This invention has been explained with respect to the specific embodiments. However, it is apparent that various modifications to this invention can be made without departing from the scope thereof.

What is claimed is:

1. A throwaway type gas lighter comprising:

a windbreak;

a fuel tank for receiving a liquified fuel gas and including a supply pipe leading therefrom;

a spark generating mechanism including a rasp wheel, a flint and a spring for urging said flint toward said rasp wheel; and fuel supplying means including a disc member mounted on said tank adjacent said spark generating mechanism and into which said supply pipe is implanted; a injection pipe received in an outer valve member made of a softened flexible material and inserted into a hole of said disc, closed on its end adjacent said supply pipe and formed with a lateral hole terminating in an inlet end normally disposed in confronting relationship with said outer valve member to seal against flow from said supply pipe to the interim of said fuel injection pipe; an arm plate connected between said spark generating mechanism and said injection pipe and means pivotally mounting said spark generating means on said fuel tank so that in operation the arm plate is arranged to push the free end of said injection pipe away from its normal position to space said inlet end away from said disc to enable fuel to flow from said supply pipe into said injection pipe.

2. A throwaway type gas lighter as defined in claim 1, wherein:

a fuel supply adjusting means including a knob for rotating said injection pipe whereby the direction of the lateral hole is variable to adjust the fuel flow rate.

3. A throwaway type gas lighter as defined in claim 1 that includes:

a shaft mounting said spark generating mechanism on said fuel tank for pivoting of said mechanism to carry said flint toward said injection pipe;

and said outer valve member urging said mechanism to a position with said inlet end in its normal sealing position against a washer having a through-hole therein.

4. A throwaway type gas lighter as set forth in claim 3, wherein:

said fuel supply adjusting means including a knob for rotating said injection pipe whereby the direction of the lateral hole is variable to adjust the fuel flow rate.

* * * * *